US005119592A

United States Patent [19]

Westfall et al.

[11] Patent Number: 5,119,592

[45] Date of Patent: Jun. 9, 1992

[54] BALANCE SYSTEM FOR LATERALLY BIASED SASH GUIDES

[75] Inventors: Norman R. Westfall, Rochester; William P. Newton, Spencerport; John I. Habbersett, Rochester, all of N.Y.; John T. Forbis, Gibsonia, Pa.

[73] Assignee: Caldwell Manufacturing Company, Rochester, N.Y.

[21] Appl. No.: 632,107

[22] Filed: Dec. 20, 1990

[51] Int. Cl.[5] ..... E05D 13/00

[52] U.S. Cl. ..... 49/454; 49/161; 49/414; 49/419; 49/430; 49/446

[58] Field of Search ..... 49/454, 453, 446, 445, 49/419, 414, 161, 176, 429, 430, 181, 417

[56] References Cited

U.S. PATENT DOCUMENTS

| | | | |
|---|---|---|---|
| 2,952,048 | 9/1960 | Graham | 49/454 X |
| 3,195,194 | 7/1965 | Young, Jr. | 49/446 |
| 3,498,000 | 3/1970 | Nobes | 49/454 X |
| 3,499,248 | 3/1970 | Baer | 49/446 X |
| 3,724,131 | 4/1973 | Schnormeier | 49/446 X |
| 4,283,883 | 8/1981 | Sterner, Jr. | 49/454 X |
| 4,581,850 | 4/1986 | Simpson | 49/446 X |
| 4,993,188 | 2/1991 | Erickson et al. | 49/454 X |

*Primary Examiner*—Philip C. Kannan
*Attorney, Agent, or Firm*—Eugene Stephens & Associates

[57] ABSTRACT

Counterbalance mechanisms for a vertically movable sash have components extending downward within guides on which the sash moves. The guides can move laterally of the sash to allow the sash to tilt and be removed from the window, and the counterbalance components are arranged within the guides to accommodate such lateral movement. Slots in the guides accommodate interconnections between counterbalance components within the guides and the sash running vertically against outward surfaces of the guides, and these interconnections also allow lateral movement of the guides and tilting of the sash. The guides are mounted on window jambs by resilient elements that bias the guides into engagement with sash grooves and also accommodate lateral movement of the guides out of the sash grooves, to allow the sash to tilt.

12 Claims, 8 Drawing Sheets

BALANCE SYSTEM FOR LATERALLY BIASED SASH GUIDES

BACKGROUND

A sash could be arranged to move vertically within a window on a pair of laterally biased guides pressed into engagement with grooves on opposite stile edges of the sash. Such guides could be mounted on the jambs to be spread apart, against their spring bias, for moving out of the sash grooves and allowing the sash to tilt and be removed from the window. A counterbalance system for such a guided sash could advantageously be arranged within the guides, but any such counterbalance system would have to accommodate the lateral movement required of the guides when the sash is tilted out of the window plane.

We have addressed the problem of a counterbalance system having components disposed within such laterally biased guides in a way that allows the guides to move apart for tilting the sash while the counterbalance system remains connected to the sash. Our counterbalance system includes several alternatives devised to accomplish this, and to do so economically and efficiently, so that the overall cost is reasonable, considering the performance of the window.

A window benefitting from our counterbalance system cooperating with such laterally biased guides can dispose a sash to run clear of the window jambs, on the relatively smaller surfaces of the guides alone. This can provide adequate frictional resistance to vertical movement of the sash, while using a relatively small lateral bias force. Such sash guides can also provide weather seals between the sash and the jamb and can hold the sash securely enough to provide adequate blowout resistance. Prototype experience has shown that such a window can operate very well, compared with existing alternatives, and can also offer desirable new design alternatives.

SUMMARY OF THE INVENTION

As applied to a sash moving between a pair of laterally biased guides, as explained above, our counterbalance system mounts a counterbalance device within the window so that a component applying an uplifting force extends downward within a sash guide in a way that allows a vertical mid-region of the guide to move laterally. This allows the guide to move out of the sash groove it engages and allows the sash to tilt and be removed from the window. The interconnection between the counterbalance component and the sash is accommodated by a slot formed in the region of the guide that enters into the sash groove. The slot in the guide allows the interconnection to move vertically with the sash, and the interconnection allows lateral movement of the guide for tilting the sash while maintaining its connection with the counterbalance component. A resilient support mounts the guide in the window, biases the guide into the sash groove, and accommodates lateral movement of the guide out of the sash groove, for tilting the window.

Such a counterbalance system allows the counterbalance mechanism and its interconnection to the sash to take several forms. The arrangement also allows several forms of a slot or slit in the guide to accommodate the different connections between the sash and a counterbalance component. Windows using these arrangements can be made of a variety of materials, including wood, plastics, metals, and combinations of these.

DRAWINGS

FIGS. 1 and 2 are partially schematic and partially cutaway elevational views of a sash running between a pair of vertical guides housing a counterbalance system allowing the sash to be respectively vertical and tilted according to our invention.

FIG. 3 and 4 are partially schematic cross-sectional views of the window of FIGS. 1 and 2, taken respectively along the line 3—3 of FIG. 1 and the line 4—4 of FIG. 2.

DETAILED DESCRIPTION

Figure 1:
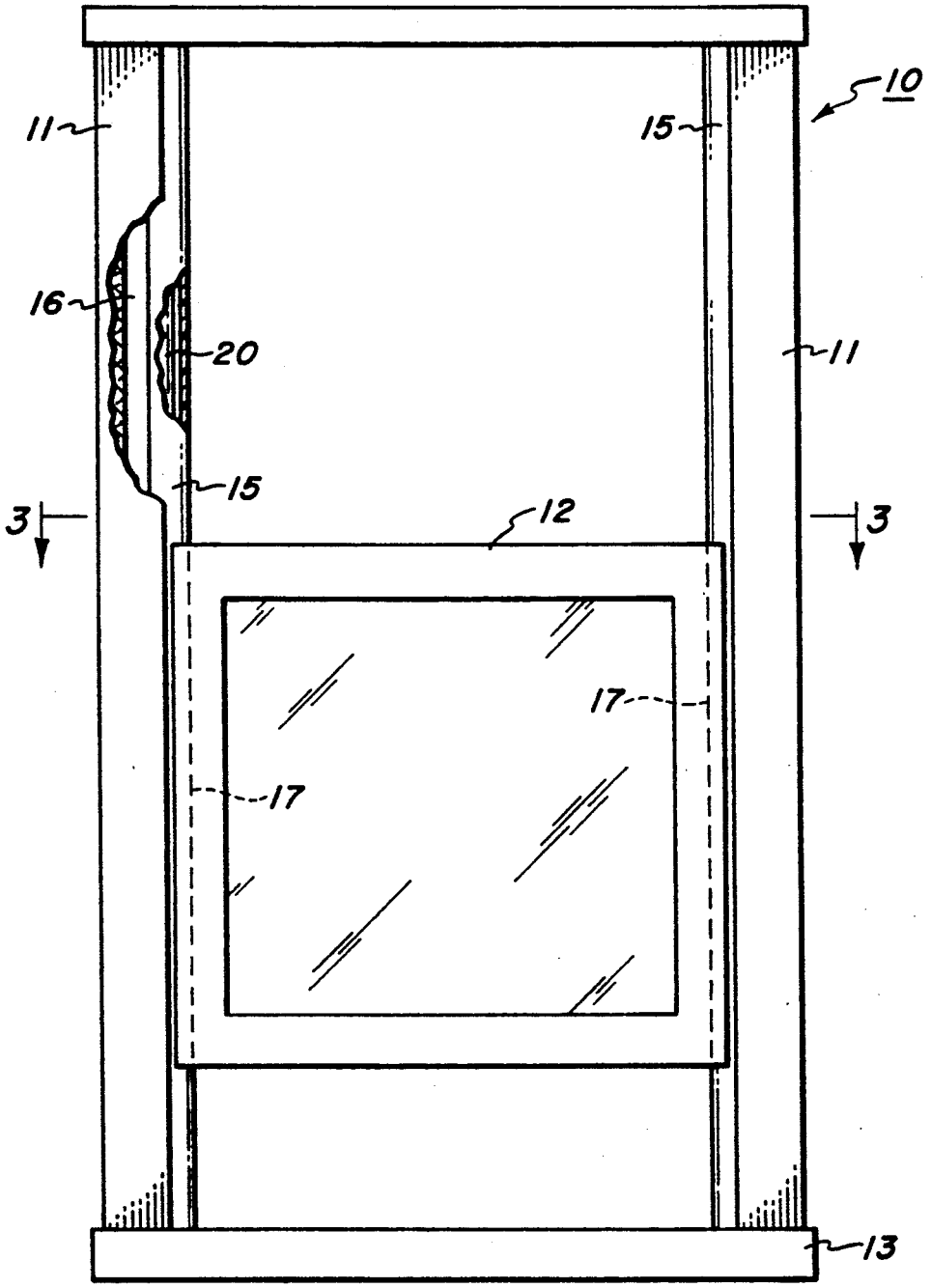

FIGS. 1–4 show the basic guided sash environment that can benefit from our counterbalance system. Window 10 includes jambs 11, sash 12, and sill 13; and a pair of sash guides 15 are mounted in jambs 11 to guide the vertical travel of sash 12. Guides 15 are laterally biased by springs 16 so that they press into grooves 17 extending vertically up the stiles on opposite edges of sash 12. This supports sash 12 on guides 15 so that sash 12 is held securely within window 10 and is free to move vertically between jambs 11. Springs 16 can take various forms, as explained more fully below, and are shown in FIGS. 1–4 as resiliently compressible foamed resin material. Springs 16 are preferably adhered to guides 15 and to jambs 11, for both mounting and biasing guides 15.

Figure 2:
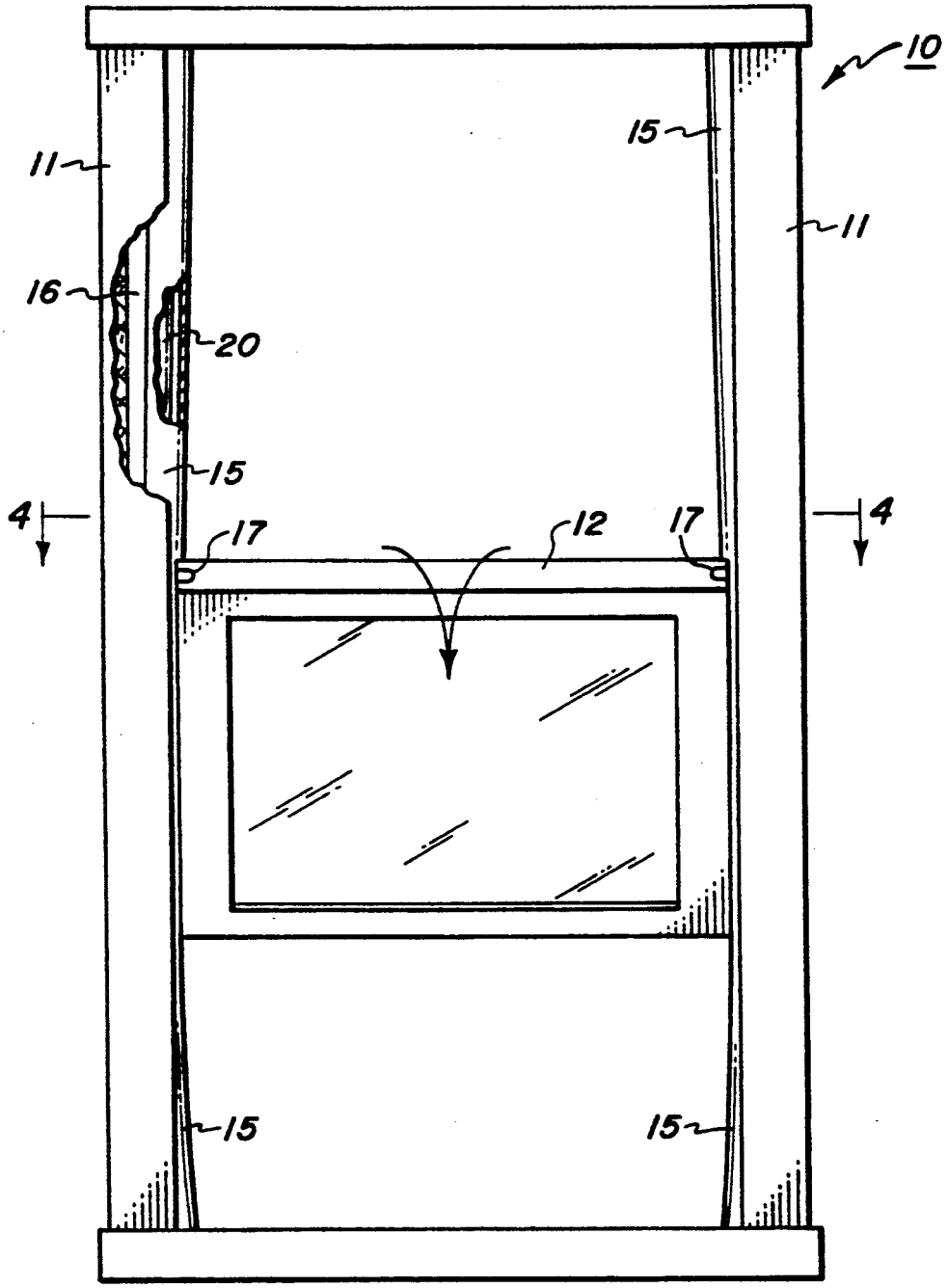
Figure 3:
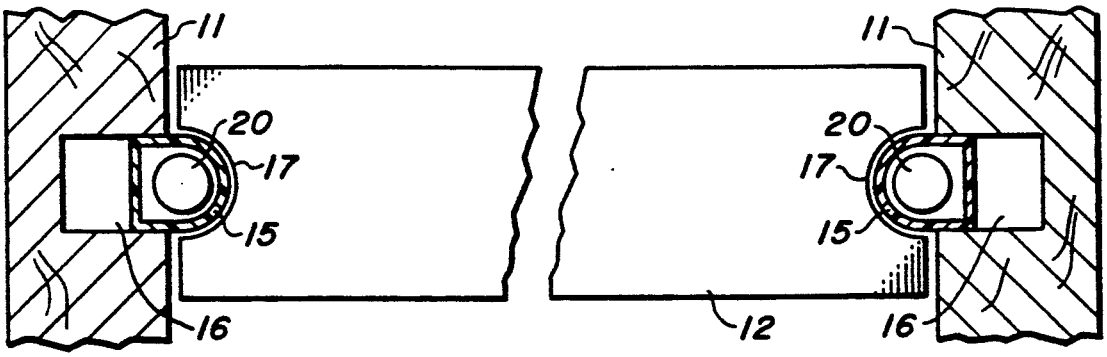
Figure 4:
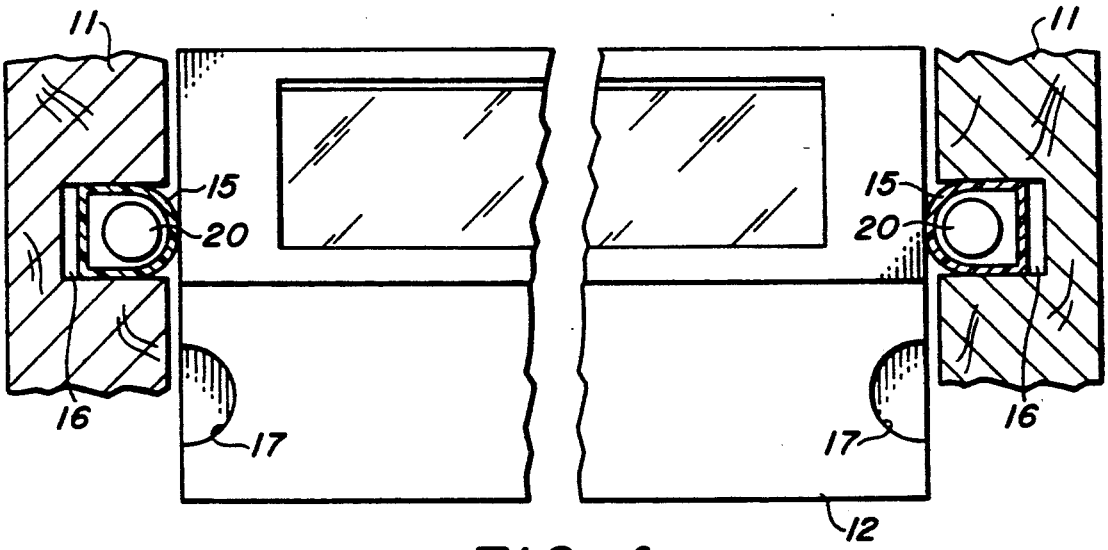

Sash 12 can tilt from its vertical plane between guides 15, as shown in FIGS. 2 and 4, by spreading guides 15 apart, against the bias of springs 16. If guides 15 are spread apart far enough to be retracted from sash grooves 17 at an upper region of sash 12, which can be done by the sides of hands gripping the top corners of sash 12, then the upper region of sash 12 can be pulled out of the vertical window plane to begin a tilting motion. As tilting of sash 12 increases, the tilting action cams guides 15 out of grooves 17 and moves guides 15 apart along the full length of sash 12, down to the lower region of sash 12, which can then tilt all the way to a horizontal position. Sash 12 is also preferably removable from window 10, as explained more fully below.

Counterbalance devices 20 are arranged within guides 15 to exert an uplifting force on sash 12, counterbalancing its weight, so that sash 12 moves easily up and down within window 10. Counterbalance devices 20 can take several forms and can be connected in several ways to sash 12, both as explained more fully below. The result illustrated in FIGS. 1–4 is a sash 12 that guides vertically on the relatively small surface area of guides 15, while running out of contact with jambs 11. This reduces the force required of springs 16, compared with bias forces applied to an entire jamb liner having two runs for a pair of sash, as has been common in the window art. The penetration of guides 15 into grooves 17 is also adequate for securely supporting sash 12 against wind forces to provide blow out resistance, and for providing an adequate weather seals between jambs 11 and sash 12. The friction between guides 15 and grooves 17 can be made reasonably small and can be designed for compatibility with the counterbalance devices, to ensure against hop or drop. The guided sash arrangement also allows window 10 to be formed of a variety of materials, including wood, plastics, metals, and combinations of these. With a counterbalance system cooperating with guides 15 and having components housed within guides 15, the guided sash arrangement of FIGS. 1–4 can perform well as a window system and can also be made inexpensively, compared with existing systems.

The basic system of FIGS. 1–4 accommodates many variations in the mounting and operating of balance devices and in interconnecting these with a sash. All workable arrangements must accommodate the lateral movement that is necessary for guides 15 to press into sash grooves 17 during normal window operation and to move laterally out of sash grooves 17 for allowing sash 12 to tilt. This accommodation of lateral movement of guides 15 places a new requirement on the counterbalance system, and this requirement can be met in several ways as shown in the alternatives described below.

Figure 5:
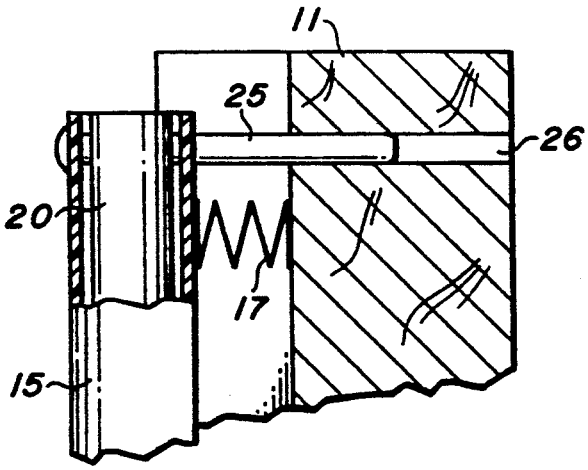
FIGS. 5 and 6 are partially schematic, fragmentary, and partially cutaway elevational views of respective normal and tilt positions of a balance and guide mounting arrangement according to our invention.
Figure 6:
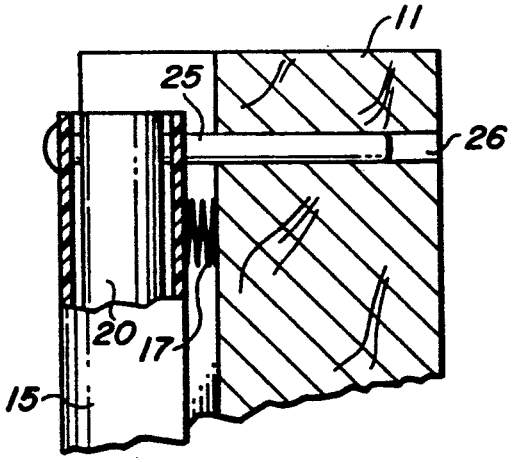

A complete counterbalance 20 can be arranged within each guide 15 so that counterbalances 20 move laterally with guides 15. One preferred way of arranging for this is shown in FIGS. 5 and 6, where a pin 25 extends through upper regions of guide 15 and counterbalance 20, connecting these together. Pin 25 also accommodates lateral movement of guides 15, under the bias of springs 17, shown as coil springs in FIGS. 5 and 6, by extending into a hole 26 in jamb 11. Jamb 11 then upholds pin 25 against downward force on counterbalance 20, exerted by the weight of a sash. At the same time, pin 25 is free to move in and out of hole 26, so that guide 15 can move laterally, as required. Pin 25 is securely interconnected with the upper region of balance 20 to be held in a preferably perpendicular orientation so that it can slide freely in and out of hole 26 while supporting downward force on balance 20.

The supporting pin arrangement of FIGS. 5 and 6 can be applied to a variety of counterbalance devices, including block and tackle, spiral, clock spring, extension spring, and pneumatic, any of which can be sized to fit within a guide 15. Supporting pin 25 can also slide within a hole in a plastic jamb 11, where it would operate in a similar way to uphold the balance against the force of the sash weight. Spring bias for guides 15 can take different forms along the vertical length of guides 15, to provide the force desired for lateral movement of the guide at any level. We have found that lateral movement of counterbalances 20 mounted on pin 25 does not impair the counterbalance performance so long as pin 25 and jamb 11 effectively uphold the counterbalances against the sash weight.

Figure 7:
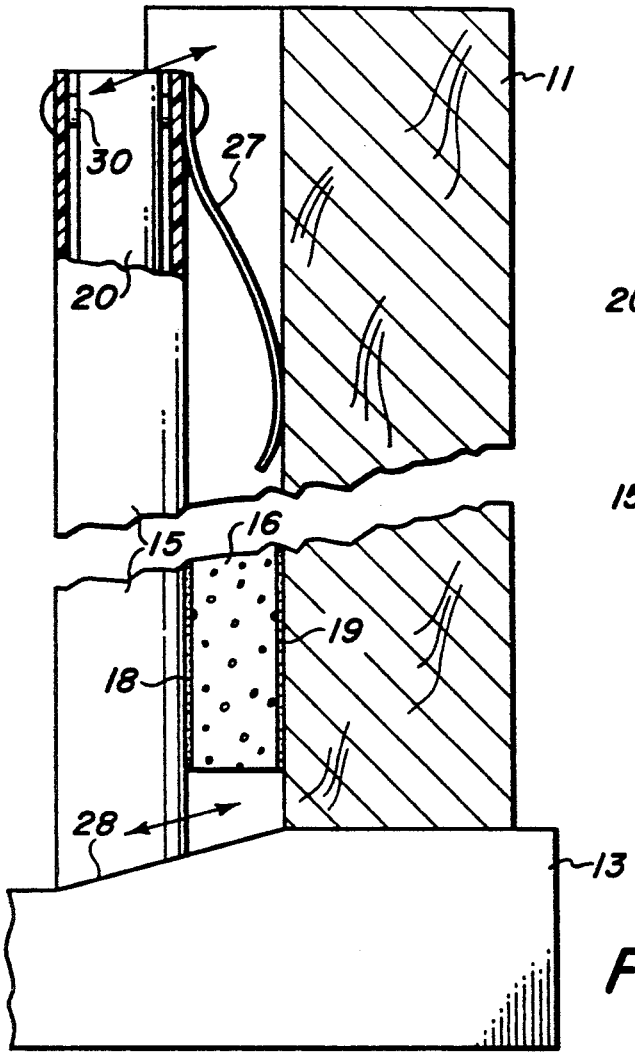
FIGS. 7 and 8 are partially schematic, partially cutaway elevational views of two alternative mounting arrangements for a guide and a balance according to our invention.

Another way of mounting a counterbalance device 20 within a guide 15 to accommodate lateral movement of the guide is shown schematically in FIG. 7, where balance 20 is connected to guide 15, which stands on sill 13 to uphold balance 20. Guide 15 is preferably formed of extruded aluminum, to have adequate compressive strength for standing on sill 13 and upholding balance 20 against the downward force of sash weight. The upper regions of balance 20 and guide 15 are interconnected by pin 30, which does not engage or extend into jamb 11. Resiliently compressible foam material 16 is preferably connected to guide 15 by adhesive 18 and to jamb 11 by adhesive 19 so that spring 16 both mounts and laterally biases guide 15. Extra spring force biasing the upper region of guide 15 is provided by a leaf spring 27, held in place by pin 30. As guide 15 moves laterally against the bias of springs 16 and 27, it also moves up and down a cam slope 28 on sill 13 that can help guide 15 return to its sash-engaging position. Variations in the springs involved in biasing guide 15 can also ensure that guide 15 can move laterally while standing on sill 13 to uphold counterbalance 20.

Figure 8:
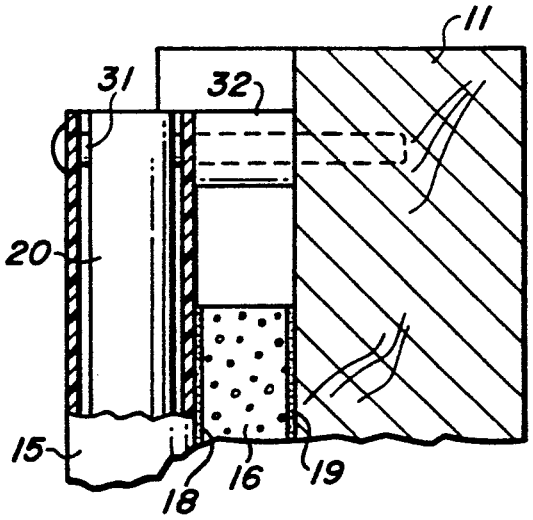

Another balance-mounting alternative, schematically shown in FIG. 8, involves fixing the upper region of guide 15 and balance 20 against lateral movement, while allowing lower regions of guide 15 and counterbalance 20 to move laterally. Tilting of a sash ordinarily does not occur when the sash is in an elevated position high up in the window. In fact, sash tilting is more convenient when the top of the sash is at chest height in a mid-region of a window. Tilting of sashes in a relatively lower position, as is convenient and desirable anyway, does not require that the upper region of guide 15 and counterbalance 20 be able to move laterally. The resin and metal materials preferred for guides 15 give them sufficient flexibility to bend aside in mid-regions, for allowing its sash to tilt, while the guides are fixed against lateral movement in their upper regions. Counterbalance devices 20, such as are preferred for counterbalancing window sash, are also sufficiently flexible to accommodate lateral movement below a fixed upper region.

As shown schematically in FIG. 8, a pin 31, which can be formed as a screw, bolt, or other fastener, extends through upper regions of guide 15 and counterbalance device 20 and into jamb 11. A spacer 32 around pin 11 spaces the upper region of guide 15 in the proper position relative to jamb 11, for extending into and engaging a groove in a sash. In regions below anchoring pin 31, spring 16 biases guide 15 and counterbalance 20 and allows these to move laterally to accommodate sash tilting.

Figure 9:
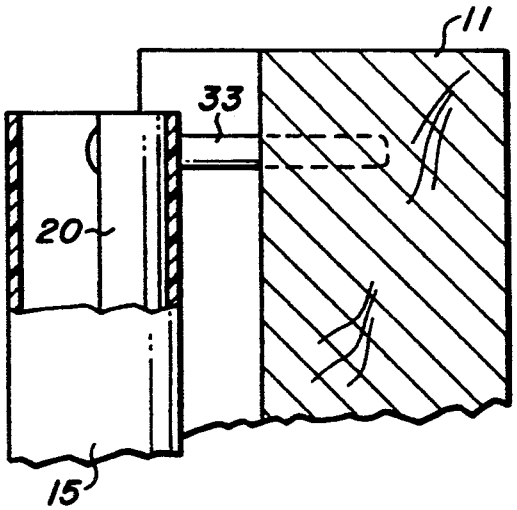
FIGS. 9 and 10 are partially schematic, fragmentary, and partially cutaway elevational views showing two positions of another alternative mounting arrangement for a guide and balance according to our invention.
Figure 10:
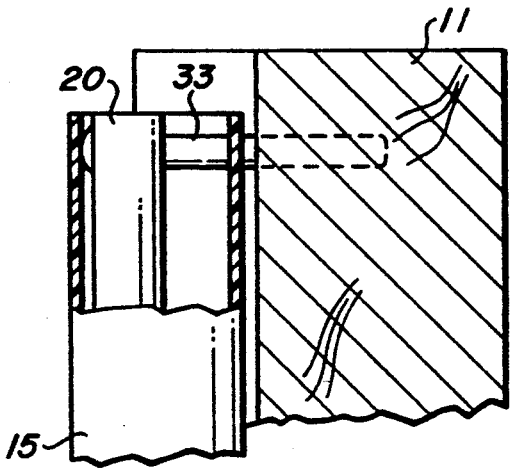

Another alternative for mounting counterbalance 20 and guides 15 on jamb 11 is schematically shown in FIGS. 9 and 10. Here guide 15 is made substantially larger than counterbalance device 20 so that guide 15 can move laterally while counterbalance device 20 remains laterally fixed in position. This is shown schematically in FIGS. 9 and 10 by means of a pin 33, which can be a screw or other fastener, fixed to an upper region of balance 20 and fixed to jamb 11. Pin 33 extends loosely through guide 15 so that guide 15 is free to move between the positions shown in FIGS. 9 and 10, without any lateral movement occurring for counterbalance device 20.

Another way that the arrangement of FIGS. 9 and 10 can be made to work is to mount the spring or resilient element of counterbalance device 20 outside of guide 15, preferably in a top region of the window, and extend a relatively small component, such as a cord, cable, or tape, down through guide 15 to engage a sash. Guide 15 can then be sized for appropriate engagement with a sash and for lateral movement relative to the sash, which the small counterbalance component can readily accommodate.

Figure 11:
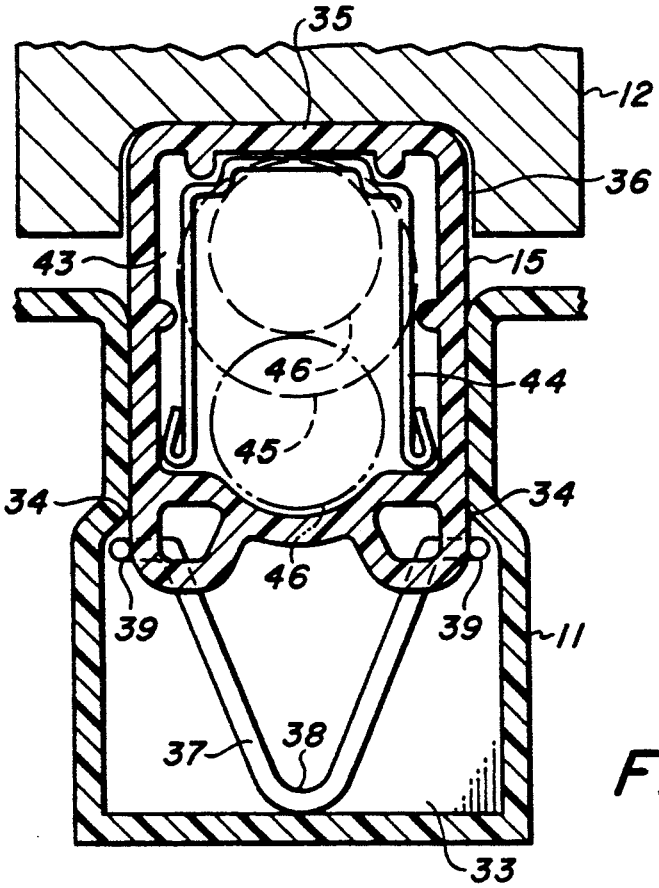
FIGS. 11 and 12 are fragmentary cross-sectional views of alternative configurations of guides containing balance systems and mounted within jambs to engage sash grooves according to our invention.

FIG. 11 schematically shows some of the possible details involved in configuring guide 15 to accommodate counterbalance systems and to be mounted for lateral movement within a jamb 11 to engage a sash 12. Guide 15 has a configuration that can be extruded from a suitable resin material, such as polyvinyl chloride. It has a blunt nose region 35 that engages a similar shape groove 36 formed in the edge of sash 12. Jamb 11 is also configured to be formed of an extruded resin material, with a recess 33 receiving guide 15. A wire spring 37 has a pressure foot 38 engaging the bottom of recess 33 in jamb 11 and gripping fingers 39 that engage and interlock with an inner region of guide 15. Fingers 39 are wider than shoulders 34 in recess 33 so that fingers 39 prevent guide 15 and its wire springs 37 from moving out of recess 33. At the same time, wire springs 37 press guide 15 outward to the illustrated sash-engaging position. Guides 15 can be urged laterally out of sash grooves 36 against the bias of wire springs 37, for tilting sash 12.

Within a central interior 43 in guide 15 are schematically illustrated several forms of counterbalance devices, to show how these can be accommodated within the space available in chamber 43. The schematically illustrated counterbalance elements include a block and tackle counterbalance device 44, having a channel in which a counterbalance spring and pulley system can be arranged, a coiled extension spring 45, and one or two spiral balances 46. A pneumatic counterbalance can also be arranged within guide chamber 43.

Figure 12:
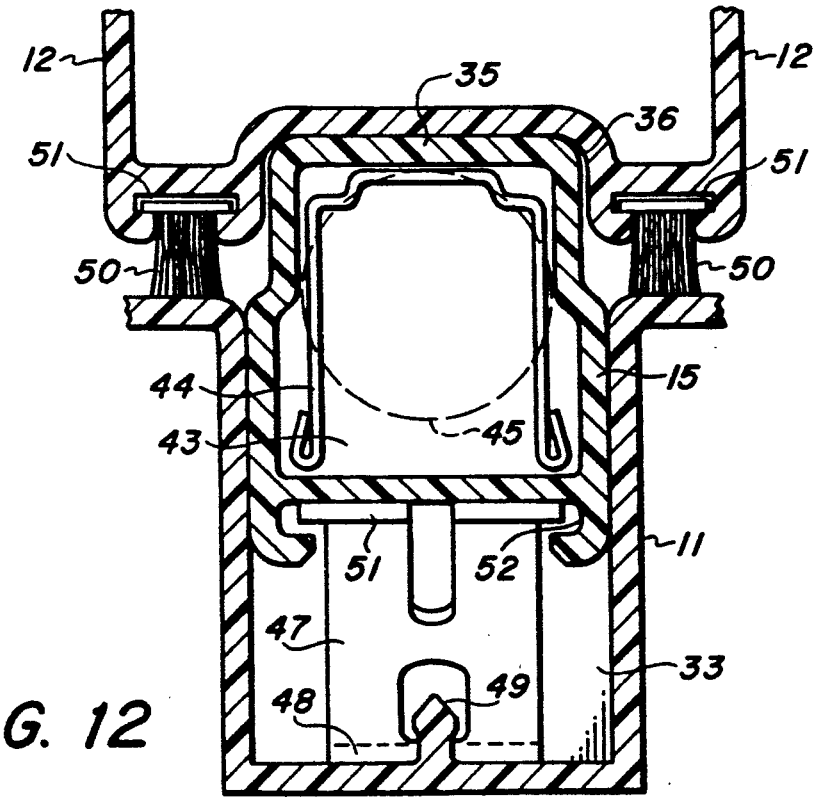
Figure 13:
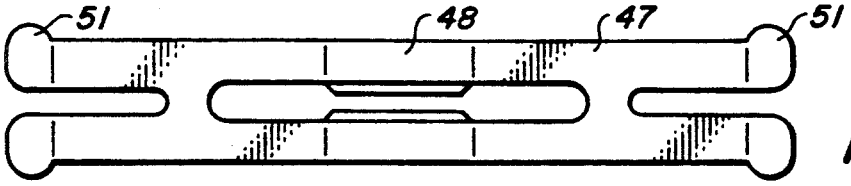
FIGS. 13 and 14 are respective plan and elevational views of a leaf spring arranged for mounting the guide of FIG. 12.
Figure 14:
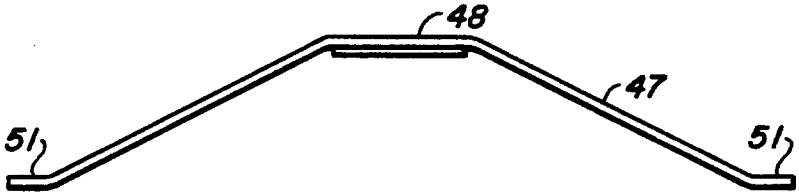

The counterbalance system of FIG. 12 includes a guide 15 having a different cross-sectional configuration, suitable for extrusion of a resin material, and another configuration of jamb 11 having a recess 33 and also being configured for extrusion of resin material. Sash 12, in the arrangement of FIG. 12, is also configured for extrusion, preferably of a resin material such as polyvinyl chloride. Again, a guide nose 35 engages a similar shaped groove 36 in sash 12. Chamber 43, within guide 15, can hold the schematically illustrated block and tackle counterbalance 44 or coiled extension spring 45, as well as spiral or pneumatic balances, which are not illustrated.

Pile weather strips 50 are arranged in slots 51 formed in sash 12 on opposite sides of groove 36, so that weather strips 50 can engage and seal against jamb 11, on opposite sides of recess 33. Other forms of weather strips and other ways of mounting weather strips are also able to cooperate with our counterbalance system within laterally movable guide 15. Also, some weather sealing occurs simply from the engagement of guide nose 35 with groove 36 in sash 12.

A leaf spring 47 mounts and retains guide 15 within recess 33 in jamb 11. A pressure foot 48 of leaf spring 47 engages an extruded retainer 49 extending into recess 33, and free ends 51 of leaf spring 47 are held for sliding movement within a spring retainer groove 52 formed in guide 15. Leaf springs 47 are thus retained within recess 33 by the interlock with retainer projection 49 and are interlocked with guides 15 within spring retainer groove 52 so that springs 47 both mount and bias guides 15. Leaf springs 47 can be snapped into position, and guide 15 can be snapped into recess 33 where it is held against removal while mounting and biasing guide 15 against sash 12.

Figure 15:
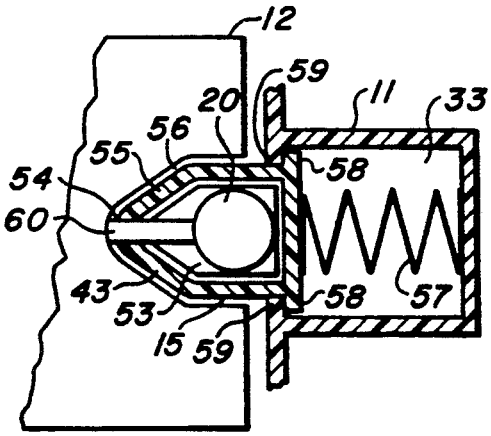
FIGS. 15 and 16 are partially schematic, cross-sectional views of two more alternative arrangements of guides containing counterbalance components for mounting in jambs and engaging a sash according to our invention.

Another form of guide 15 having a more pointed nose 55 engages a similar shaped groove 56 in sash 12, as schematically illustrated in FIG. 15. Jamb 11 is formed with a recess 33 that contains coil balance springs 57, biasing guide 15 outward. Interferring shoulders 58 and 59, on guide 15 and jamb 11, prevent guide 15 from moving out of jamb recess 33. Within chamber 43 in guide 15 is a shoe 53 that can move up and down with sash 12, and a pin 60 that interconnects sash 12 with shoe 53. Pin 60 extends through a slot 54 formed in the nose region of guide 15 and can be attached either to sash 12 or guide 53. Pin 60 extends far enough so that shoe 53 remains connected with sash 12 when guide 15 is urged out of sash groove 56, during tilting of sash 12.

Slot 54 preferably extends from the bottom of guide 15 to a mid-region of guide 15, to accommodate vertical travel of sash 12. Counterbalance device 20, which can have several forms, interconnects with shoe 53 and exerts upward force on shoe 53 to counterbalance the weight of sash 12.

Figure 16:
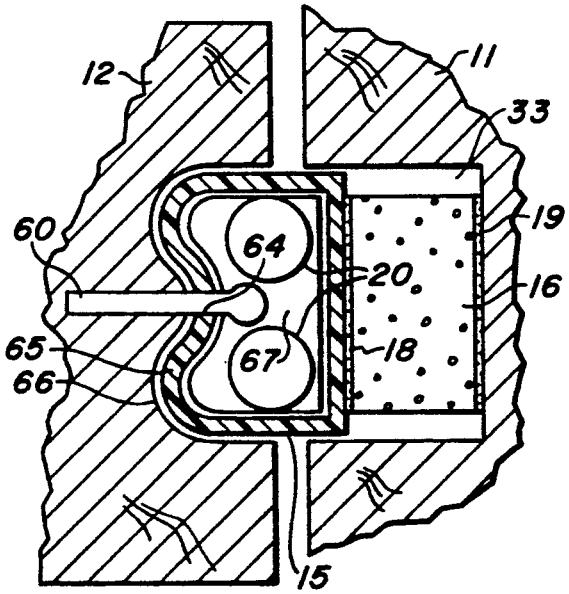

Guide 15, as schematically illustrated in FIG. 16, has an S-curved nose region 65 fitting within a similarly curved groove 66 in sash 12. A slot 64 in guide nose 65 accommodates vertical travel of sash pin 60, which releasably engages a sash shoe 67 running vertically within guide 15. The S-curve shape of guide 15 accommodates a pair of spiral balances 20, but other forms of counterbalance devices can also be used. A compressible resilient foam spring 60 attached to guide 15 by adhesive 18 and to jamb recess 33 by adhesive 19 mounts and biases guide 15 so that its S-shaped nose 65 provides weather sealing in addition to an effective running fit within sash groove 66.

Figure 17:
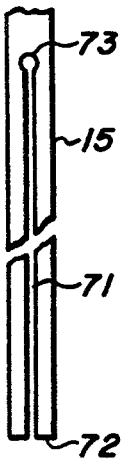
FIGS. 17 and 18 are partially cutaway elevational views of guides having a slot (FIG. 17) or a slit (FIG. 18) accommodating an interconnection between a sash and a counterbalance component arranged within the guide according to our invention.
Figure 18:
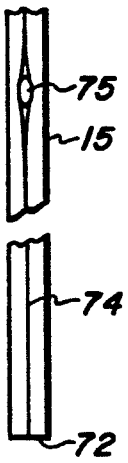

The guides 15 of FIGS. 17 and 18 illustrate variations in vertical slots or slits that accommodate an interconnection between a counterbalance component arranged within the guides and a sash running on outside surfaces of the guides. The guide of FIG. 17 has a slot 71 preferably extending from the guide bottom 72 upward to a mid-region of the guide, where slot 71 preferably terminates in a keyhole shape 73. This can allow a headed sash pin to move in and out of guide 15 only at keyhole opening 73 in a mid-region of guide 15. There, the counterbalance system cooperating with guide 15 can go slack so that a shoe or other component within guide 15 can be engaged by a headed sash pin inserted through keyhole opening 73.

The guide of FIG. 18 has a vertically extending slit 74 that preferably extends from the bottom 72 upward for the full length of guide 15. Slit 74 can be formed continuously as guide 15 is extruded, so that slit 74 does not add to the cost of guide 15. With guide 15 being formed of flexible resin material, as preferred, the edges of slit 74 can be spread apart by the sides of a sash pin 75 that moves vertically with the sash. The edges of slit 74 reclose into contact with each other, to keep guide 15 closed except in a region where pin 75, or other connection with a sash, spreads open slit 74. The opening of slit 74 as connector 75 moves vertically in guide 15 produces some additional friction that can be added to other frictional forces, for preventing hop or drop of a sash.

Figure 19:
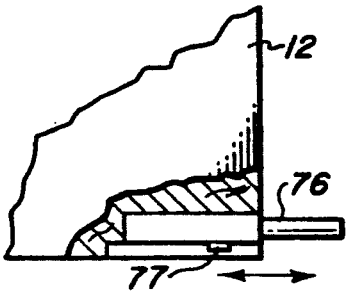
FIG. 19 is a fragmentary, partially schematic, and partially cutaway view of a retractable sash pin cooperating with a counterbalance system according to our invention.

The lower corner of sash 12, illustrated in FIG. 19, is partially cut away for illustrating a retractable sash pin 76 that can be moved back and forth by means of an operating lug 77. Sash pin 76 is thus a form of barrel bolt or surface bolt, which can be made in many configurations. Pin 76 can be spring biased into an extended position or manually moved to an extended position in which it engages a sash shoe or other component of a counterbalance system within the guide. Movement of pin 76 back and forth, as indicated by the double-headed arrow, facilitates removing and replacing sash 12.

Figure 20:
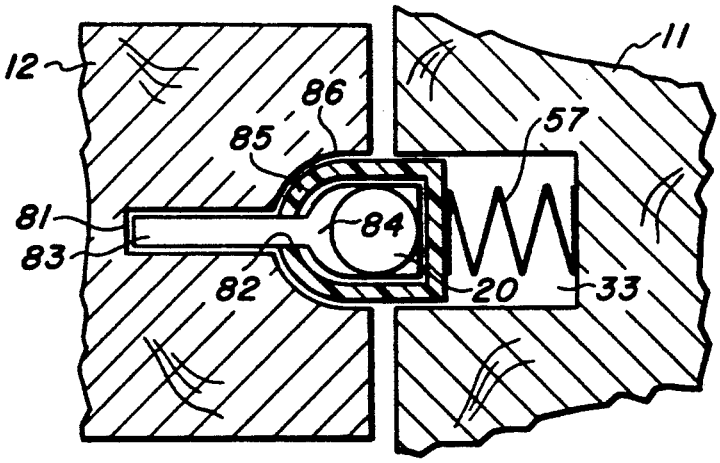
FIG. 20 is a cross-sectional view of another embodiment of a guide having a shoe with a sash pin arranged for engaging a sash according to our invention.
Figure 21:
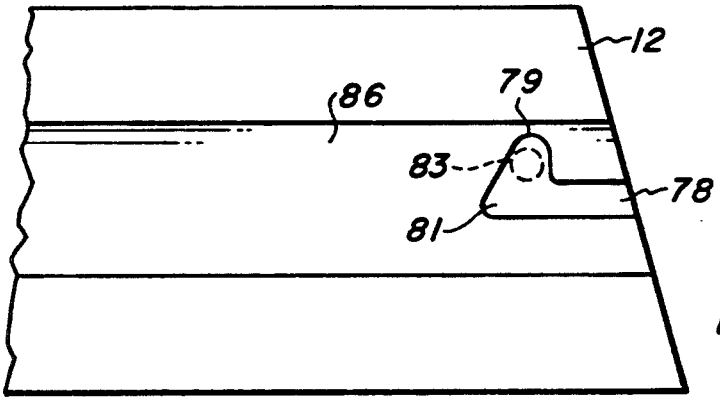
FIG. 21 is a fragmentary view of a lower corner of a tilted sash having a groove for receiving the sash pin of FIG. 20.

The guide 15 of FIG. 20 is mounted in recess 33 of jamb 11 on springs 57 so that its rounded nose 85 engages a similarly rounded groove 86 in sash 12. A shoe 84 biased upward by counterbalance device 20 has a pin 83 that extends through a slot 82 in guide 15 to engage sash 12. As best shown in FIG. 21, a recess 81 is formed in sash groove 86 in an L-shape, as illustrated, to receive pin 83. Tilting sash 12 to a horizontal position, as illustrated in FIG. 21, lets the tilt portion 79 of groove 81 rest on sash pin 83 to support the weight of sash 12. This can be lifted upward so that pin 83 enters the straight portion 78 of groove 81, which allows sash 12 to be slid horizontally out of the window. To replace sash 12 only requires biasing guides 15 apart enough to insert the lower end of sash 12 in between guides 15 so that pins 83 enter the straight portions of grooves 78. Then when sash 12 is tilted back to the vertical plane, it rests the upper portion of its grooves 81 on pins 83 so that shoe 84 and counterbalance device 20 helps support the weight of sash 12.

Figure 23:
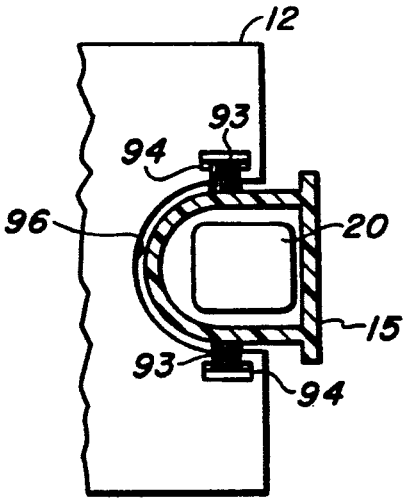
FIGS. 22 and 23 are fragmentary cross-sectional views of alternative embodiments of guides containing counterbalance elements and having a weather sealing interengagement with a sash according to our invention.
Figure 22:
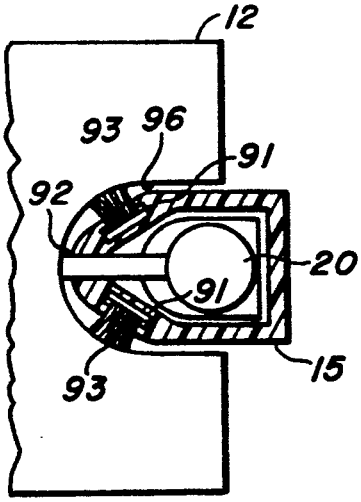

FIGS. 22 and 23 show alternative arrangements for a weather stripping element that interengages guides 15 and sashes 12. In the arrangement of FIG. 22, grooves 91 are formed in the nose region of guide 15 on opposite sides of slot 92 for sash pin 90. Pile weather stripping elements 93 are mounted in grooves 91 to engage inside surfaces of sash groove 96, for weather stripping purposes. Weather seals other than pile elements 93 can also be used, and weather seals arranged for interengagement between guide 15 and sash 12 are desirable, because they can be pressed into a sealing engagement by the spring force that laterally biases guide 15.

In the arrangement of FIG. 23, grooves 94 are formed in the sides of sash groove 96 to hold pile weather seal elements 93 in engagement with the sides of guide 15, running in groove 96. Again, weather seal elements other than pile strips 93 can be used, and many possible arrangements can be made for weather sealing elements mounted for interengagement between guide 15 and sash groove 96.

Figure 24:
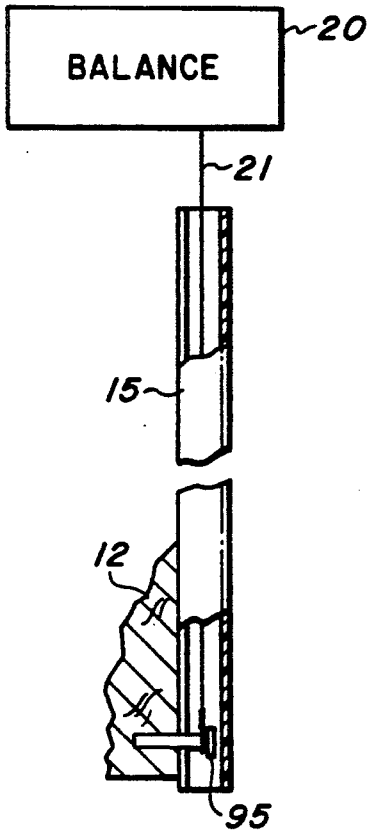
FIG. 24 is a partially schematic and partially cutaway view of another balance system having a component extending into a guide and engaging a sash according to our invention.

The counterbalance 20 for the system of FIG. 24 is mounted outside, and preferably above, guide 15 and has a component 21 that extends down through guide 15 to an interconnection with pin 95 on sash 12. Component 21 can be a cord, cable, or tape that is biased upward by counterbalance 20 to exert an uplifting force on sash 12 via pin 95. The arrangement of FIG. 24 allows guide 15 to be made much smaller, since component 21 does not require much space within guide 15. This can have both stylistic and operational advantages.

Figure 25:
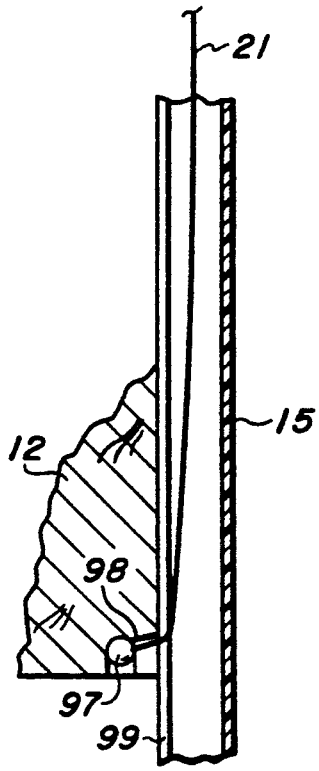
FIG. 25 is a fragmentary and partially schematic view of an alternative interconnection between a counterbalance component and a sash according to our invention.

FIG. 25 shows another arrangement of a cord serving as a counterbalance component 21 and terminating in a bead 97 that interlocks with a recess 98 in a lower corner of sash 12. A slot or slit 99 in guide 15 allows bead 97 to move vertically with sash 12 on the outside of guide 15, while bead 97 is biased upward by cord 21 within guide 15. Again, the arrangement of FIG. 25 allows a counterbalance spring or other resilient element to be mounted outside of guide 15, preferably in a top region of a window.

Figure 26:
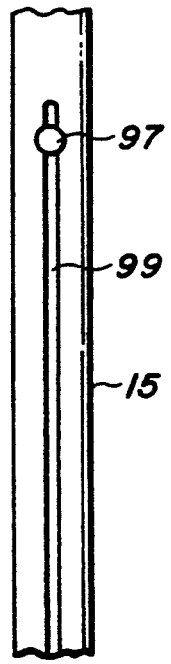
FIG. 26 is a fragmentary elevational view of the guide of FIG. 25 having a slot accommodating a counterbalance element and sash interconnector according to our invention.
Figure 27:
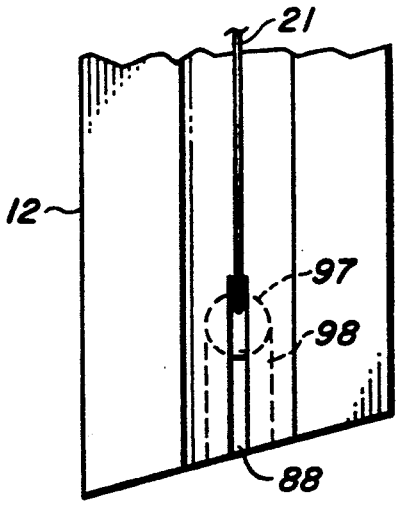
FIG. 27 is a partially schematic and fragmentary elevational view of the lower corner of the sash of FIG. 3 engaging a counterbalance connector according to our invention.

Bead 97 is shown in an upper position near the top of slot 99 in guide 15 in FIG. 26. In such a position, sash 12 can be lifted off of bead 97 and removed from the window. Sash 12 can be replaced by spreading guides 15 apart and relocating bead 97 in sash recess 98. The lower corner of sash 12, with its recess 98 arranged behind an open slot 88 to receive bead 97 attached to cord component 21, is shown in FIG. 27.

Figure 28:
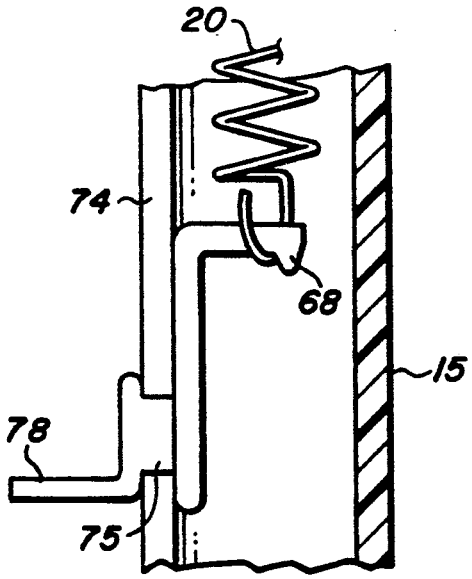
FIG. 28 is a fragmentary and partially cutaway elevational view of another form of sash interconnector extending through a slit in a guide according to our invention.

FIG. 28 relates to FIG. 18 and shows a sash platform 78 for upholding a lower corner of a sash while platform 78 is connected via pin 75 with a hook 68 that engages a counterbalance device 20, such as the illustrated coiled extension spring. The connection 75 between sash platform 78 and hook 68 slides between the edges of a slit 74 extending vertically of guide 15 so that connector 75 spreads apart the walls of guide 15 at slit 74 as it moves up and down with a sash on platform 78.

The above-described illustrations exemplify some of the many variations that are possible in arranging a counterbalance device to accommodate lateral movement of a sash guide within which a counterbalance component extends. Many of the features from the separate illustrations can be interchanged, and a great many different specific embodiments can be devised to make a counterbalance system cooperate with laterally movable sash guides.

We claim:

1. A counterbalance system for a window having a sash guided for movement in a vertical plane by a guide that resiliently engages a vertical groove in a side of said sash and allows said sash to be tilted and removed from said window, said counterbalance system comprising:

a. a counterbalance device being mounted in said window in a position within said guide where said counterbalance device is surrounded and enclosed by said guide and where the mounting of said counterbalance device is arranged to allow a vertical mid-region of said guide to move laterally out of said sash groove, so that said sash can tilt from said vertical plane;

b. at least a lower region of said guide having a divided wall confronting said sash groove;

c. an interconnector extending between said sash and a lower region of said counterbalance device being arranged to pass through said divided wall for moving vertically with said sash;

d. a resilient support being joined to said guide and to said window, for mounting said guide in a vertical position within said window, and for biasing said guide resiliently against said sash; and e. an upper region of said guide and an upper region of said counterbalance device each being fixed in place in said window against both vertical and lateral movement, and said guide and said counterbalance device being laterally movable in said mid-region below said upper region.

2. A counterbalance system for a window having a sash guided for movement in a vertical plane by a guide that resiliently engages a vertical groove in a side of said sash and allows said sash to be tilted and removed from said window, said counterbalance system comprising:

a. a counterbalance device being mounted in said window in a position within said guide where said counterbalance device is surrounded and enclosed by said guide and where the mounting of said counterbalance device is arranged to allow a vertical mid-region of said guide to move laterally out of said sash groove, so that said sash can tilt from said vertical plane;

b. at least a lower region of said guide having a divided wall confronting said sash groove;

c. an interconnector extending between said sash and a lower region of said counterbalance device being arranged to pass through said divided wall for moving vertically with said sash;

d. a resilient support being joined to said guide and to said window, for mounting said guide in a vertical position within said window, and for biasing said guide resiliently against said sash;

e. an upper region of said guide and an upper region of said counterbalance device both being mounted for lateral movement; and f. said guide and said counterbalance device being mounted on a pin that is free to move laterally within said window, but is upheld against downward movement.

3. A counterbalance system for a window having a sash guided for movement in a vertical plane by a guide that resiliently engages a vertical groove in a side of said sash and allows said sash to be tilted and removed from said window, said counterbalance system comprising:

a. a counterbalance device being mounted in said window in a position within said guide where said counterbalance device is surrounded and enclosed by said guide and where the mounting of said counterbalance device is arranged to allow a vertical mid-region of said guide to move laterally out of said sash groove, so that said sash can tilt from said vertical plane;

b. at least a lower region of said guide having a divided wall confronting said sash groove;

c. an interconnector extending between said sash and a lower region of said counterbalance device being arranged to pass through said divided wall for moving vertically with said sash;

d. a resilient support being joined to said guide and to said window, for mounting said guide in a vertical position within said window, and for biasing said guide resiliently against said sash; and e. said guide having sufficient interior space to be movable laterally relative to said counterbalance device, and an upper region of said counterbalance device being fixed to said window in a way that allows said mid-region of said guide to move laterally relative to said counterbalance device.

4. A counterbalance system for a window having a sash guided for movement in a vertical plane by a guide that resiliently engages a vertical groove in a side of said sash and allows said sash to be tilted and removed from said window, said counterbalance system comprising:

a. a counterbalance device being mounted in said window in a position within said guide where said counterbalance device is surrounded and enclosed by said guide and where the mounting of said counterbalance device is arranged to allow a vertical mid-region of said guide to move laterally out of said sash groove, so that said sash can tilt from said vertical plane;

b. at least a lower region of said guide having a divided wall confronting said sash groove;

c. an interconnector extending between said sash and a lower region of said counterbalance device being arranged to pass through said divided wall for moving vertically with said sash;

d. a resilient support being joined to said guide and to said window, for mounting said guide in a vertical position within said window, and for biasing said guide resiliently against said sash; and e. said divided wall being formed by a slot extending to a keyhole-shaped opening in said mid-region of said guide.

5. The system of claim 4 wherein said sash has a pin with a head that can fit through said keyhole-shaped opening to engage a lower region of said counterbalance device.

6. In a window having a sash that is vertically movable on a guide resiliently engaging a groove in an edge of said sash, said guide containing a component of a counterbalance mechanism and being movable laterally out of said sash groove to allow said sash to tilt from a vertical plane of said window and be removed from said window, the improvement comprising:

a. said counterbalance mechanism being mounted in said window so that said component is disposed within said guide to allow at least a mid-region of said guide to move laterally out of said sash groove so that said sash can tilt from said vertical plane;

b. said guide surrounding and enclosing said component and providing an opening extending vertically in at least a lower region of a wall of said guide to allow a vertically movable connection to be made through said wall between said sash and said component;

c. a resilient support mounting said guide in said window so that said guide is held in said window by said resilient support and is pressed into said sash groove by said resilient support; and d. said counterbalance mechanism including a spring arranged outside said guide so that said component can transmit force from said spring through said guide to said connection with said sash.

7. In a window having a sash that is vertically movable on a guide resiliently engaging a groove in an edge of said sash, said guide containing a component of a counterbalance mechanism and being movable laterally out of said sash groove to allow said sash to tilt from a vertical plane of said window and be removed from said window, the improvement comprising:

a. said counterbalance mechanism being mounted in said window so that said component is disposed within said guide to allow at least a mid-region of said guide to move laterally out of said sash groove so that said sash can tilt from said vertical plane;

b. said guide surrounding and enclosing said component and providing an opening extending vertically in at least a lower region of a wall of said guide to allow a vertically movable connection to be made through said wall between said sash and said component;

c. a resilient support mounting said guide in said window so that said guide is held in said window by said resilient support and is pressed into said sash groove by said resilient support; and d. said opening having an enlarged upper region in a mid-region of said guide and said vertically movable connection including a pin with a head that can fit through said enlarged upper region.

8. In a window having a sash that is vertically movable on a guide resiliently engaging a groove in an edge of said sash, said guide containing a component of a counterbalance mechanism and being movable laterally out of said sash groove to allow said sash to tilt from a vertical plane of said window and be removed from said window, the improvement comprising:

a said counterbalance mechanism being mounted in said window so that said component is disposed within said guide to allow at least a mid-region of said guide to move laterally out of said sash groove so that said sash can tilt from said vertical plane;

b. said guide surrounding and enclosing said component and providing an opening extending vertically in at least a lower region of a wall of said guide to allow a vertically movable connection to be made through said wall between said sash and said component;

c. a resilient support mounting said guide in said window so that said guide is held in said window by said resilient support and is pressed into said sash groove by said resilient support; and d. said opening in said guide being a normally closed slit that is spread open in the region of said vertically movable connection.

9. A sash support system for a sash that is vertically movable in a plane of a window and is tiltable from said plane and removable from said window, said support system including a pair of laterally biased guides engaging grooves in opposite sides of said sash and counterbalance mechanisms having components arranged within said guides for counterbalancing said sash, said support system comprising:

a. said counterbalance mechanism being mounted in said window with said components extending downward within said guides in a way that allows lateral movement of vertical mid-regions of said guides, so that said guides can move outside of said sash grooves and allow said sash to tilt from said window plane;

b. interconnections between said components and said sash being accommodated respectively by slots formed in said guides to confront said sash grooves, so that said slots allow said interconnections to move vertically with said sash, and said interconnections allow lateral movement of said guides and tilting of said sash while maintaining the connections between said components and said sash;

c. resilient supports mounting said guides in said window and biasing said guides into said sash grooves, said resilient supports being arranged for accommodating and resisting said lateral movement of said guides out of said sash grooves;

d. said components including cords extending to said interconnections with said sash; and e. said cords extending through said slots and connecting to said sash.

10. A sash support system for a sash that is vertically movable in a plane of a window and is tiltable from said plane and removable from said window, said support system including a pair of laterally biased guides engaging grooves in opposite sides of said sash and counterbalance mechanisms having components arranged within said guides for counterbalancing said sash, said support system comprising:

a. said counterbalance mechanisms being mounted in said window with said components extending downward within said guides in a way that allows lateral movement of vertical mid-regions of said guides, so that said guides can move outside of said sash grooves and allow said sash to tilt from said window plane;

b. interconnections between said components and said sash being accommodated respectively by slots formed in said guides to confront said sash grooves, so that said slots allow said interconnections to move vertically with said sash, and said interconnections allow lateral movement of said guides and tilting of said sash while maintaining the connections between said components and said sash;

c. resilient supports mounting said guides in said window and biasing said guides into said sash grooves, said resilient supports being arranged for accommodating and resisting said lateral movement of said guides out of said sash grooves; and d. said slots extending upward from lower regions of said guides to keyhole-shaped openings in mid-regions of said guides.

11. The system of claim 10 wherein said interconnections include sash pins having heads that fit through said keyhole openings.

12. A sash support system for a sash that is vertically movable in a plane of a window and is tiltable from said plane and removable from said window, said support system including a pair of laterally biased guides engaging grooves in opposite sides of said sash and counterbalance mechanisms having components arranged within said guides for counterbalancing said sash, said support system comprising:

a. said counterbalance mechanisms being mounted in said window with said components extending downward within said guides in a way that allows lateral movement of vertical mid-regions of said guides, so that said guides can move outside of said sash grooves and allow said sash to tilt from said window plane;

b. interconnections between said components and said sash being accommodated respectively by slots formed in said guides to confront said sash grooves, so that said slots allow said interconnections to move vertically with said sash, and said interconnections allow lateral movement of said guides and tilting of said sash while maintaining the connections between said components and said sash;

c. resilient supports mounting said guides in said window and biasing said guides into said sash grooves, said resilient supports being arranged for accommodating and resisting said lateral movement of said guides out of said sash grooves; and d. said slots being formed as normally closed cuts in walls of said guides, said cuts being spread open in regions where said interconnections pass through said slots.

* * * * *